United States Patent [19]

Wittenborg

[11] Patent Number: 4,531,342

[45] Date of Patent: Jul. 30, 1985

[54] CUP DISPENSER FOR CUPS CONTAINING FRESHLY MADE BEVERAGES

[75] Inventor: Poul E. Wittenborg, Odense, Denmark

[73] Assignee: Wittenborgs Automatfabriker A/S, Odense, Denmark

[21] Appl. No.: 416,431

[22] Filed: Sep. 9, 1982

[30] Foreign Application Priority Data

Oct. 2, 1981 [DK] Denmark ..... 4383/81

[51] Int. Cl.[3] ..... B65B 7/28; B67B 3/22

[52] U.S. Cl. ..... 53/308; 53/282; 53/312; 222/2

[58] Field of Search ..... 53/281, 282, 266 R, 53/308, 311, 312, 314, 316; 222/129.1, 129.2, 129.3, 129.4, 2; 194/3, 13

[56] References Cited

U.S. PATENT DOCUMENTS

| | | | |
|---|---|---|---|
| 2,814,317 | 11/1957 | Gale | 222/2 X |
| 2,888,167 | 5/1959 | Erickson . | |
| 2,919,830 | 6/1960 | Anderson . | |
| 3,000,408 | 9/1961 | Vischer, Jr. | 194/13 X |
| 3,261,142 | 7/1966 | Wilcox | 53/314 X |
| 3,345,801 | 10/1967 | West | 53/311 |
| 3,492,785 | 2/1970 | Mancini | 53/282 |
| 3,533,211 | 10/1970 | Einnehmer | 194/3 X |
| 3,572,007 | 3/1971 | Shelby et al. | 53/282 |
| 3,994,117 | 11/1976 | Kinney | 53/282 X |

FOREIGN PATENT DOCUMENTS

| | | |
|---|---|---|
| 1528912 | 5/1968 | France . |
| 1277168 | 10/1970 | United Kingdom . |

*Primary Examiner*—Horace M. Culver
*Attorney, Agent, or Firm*—Lester Horwitz

[57] ABSTRACT

A cup dispenser for cups containing freshly made beverages comprises a discharge opening connecting a dispensing chamber with the interior of the dispenser. This discharge opening is from the inside filled by a rotor mounted about a vertical shaft. The peripheral wall of the rotor closes completely the discharge opening in any position of the rotor apart from the position in which a recess opposes the discharge opening. This recess is shaped in such a manner that it may receive a cup situated therein when the dispenser is activated. Subsequently, the cup is filled with the desired beverage at a filling station and optionally provided with a cover at a cover dispensing device. Such a dispenser protects the interior parts thereof efficiently against the environment, and furthermore it allows the positioning of the covers on the filled cups in a simple manner.

11 Claims, 9 Drawing Figures

CUP DISPENSER FOR CUPS CONTAINING FRESHLY MADE BEVERAGES

Figure 1:
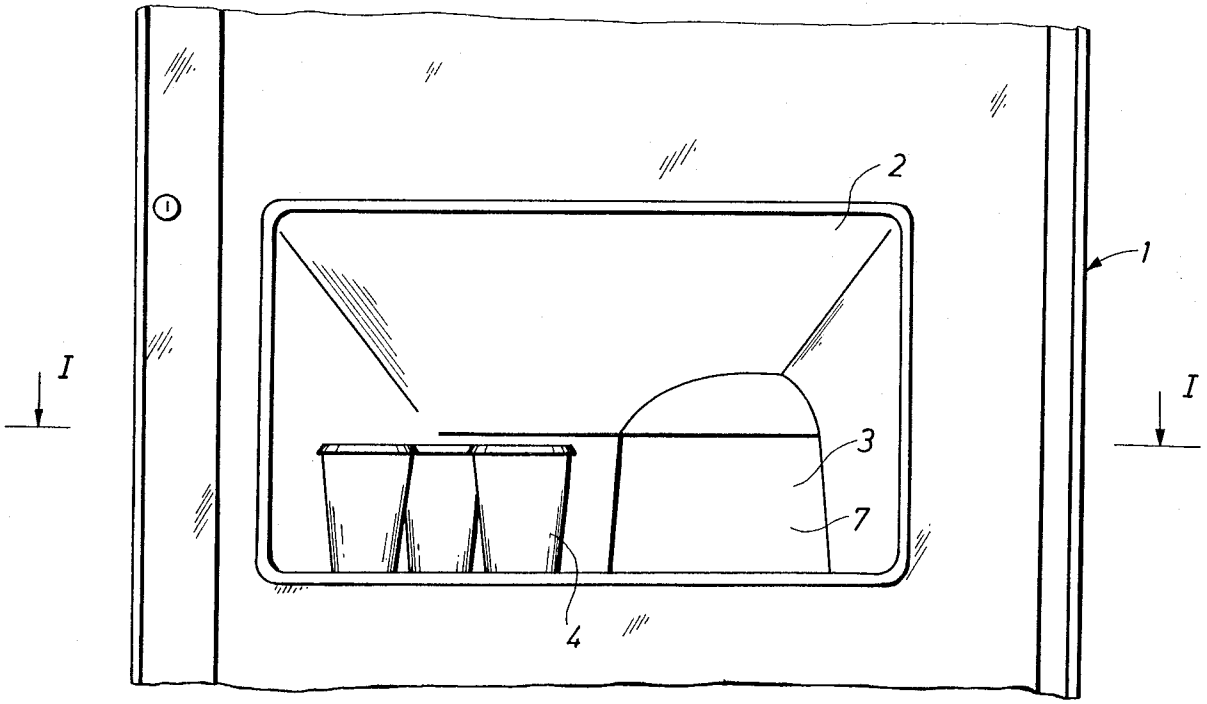

The invention relates to a cup dispenser for cups containing freshly made beverages, said dispenser comprising a discharge opening forming a connection between the interior of the dispenser and a dispensing chamber, from which the customer can remove the filled cup.

Many different types of dispensers are known which comprise a dispensing chamber in which the cup is initially situated and the beverage is subsequently made. Such dispensers are encumbered with the drawback that it is relatively easy for unauthorized persons to reach parts of the dispenser through the usually permanently open discharge opening. In addition, the parts supplying the liquid to the cup are relatively unprotected against dirt and other impurities from the environment of the dispenser. Some dispensers protect the dispensing chamber and the discharge opening against impurities from the environment by means of a door situated at the outlet of the dispensing chamber, and which the customer must open in order to remove the filled cup. It is, however, still relatively easy for unauthorized persons to reach parts of the interior of the dispenser through the open discharge opening and possibly deliberately smudge the parts adjacent the opening. The dispenser comprising a door furthermore necessitates that the customer must use both hands for the removal of the cup in order to avoid spilling.

The dispenser according to the invention is characterized in that the dispenser comprises a rotor pivotably mounted about a vertical shaft and having a peripheral wall extending in axial direction and co-operating with the discharge opening from the interior in such a manner that said discharge opening is completely closed by part of the peripheral wall in any position of the rotor apart from the position in which a cup chamber shaped on said rotor opposes the discharge opening, said cup chamber forming a recess in the peripheral wall, and that—within the dispenser—said dispenser is adapted at activation to position a cup in the cup chamber, to fill said cup with the desired beverage, and optionally to provide the cup with a cover, and subsequently to turn said cup chamber with the filled cup temporarily forward to the discharge opening.

As a result a dispenser is provided which protects the interior parts of the dispenser efficiently against wanton destruction, and which simultaneously protects the parts presenting high sanitary requirements concerning impurities from the outside. Furthermore, the movement of a filled cup within the dispenser renders it possible to provide said cup with a cover from a cover dispensing mechanism, thus meeting the various requirements presented to a beverage. A cup provided with a cover is easy to remove from the dispenser without the risk of spilling, and such a cup is furthermore easy to transport. A dispenser providing the cup with a cover increases to an essential degree the tendency of a customer to accept a cup containing a beverage usually sold in bottles. In this manner it is possible to restrict the sale of beverages in bottles involving expenses to a considerable extent. Compared to bottles, the cups are inexpensive to manufacture and transport, and unlike the bottles these cups need not be returned to the breweries.

According to the invention it is preferred that the rotor is formed as a bell, whereby the cup chamber extends substantially axially through said bell adjacent the peripheral wall thereof and comprises a separate bottom plate supporting the cups.

Moreover according to the invention, the wall of the cup chamber may be formed by telescopic members permitting an adjustment of the axial extension of the cup chamber by displacing the bottom plate of the cup chamber. In this manner the drum and consequently the dispenser are easily adaptable to various sizes of cups.

Furthermore according to the invention, the rotor may be associated with means automatically transferring a filled cup to the dispensing chamber when the cup chamber opposes said dispensing chamber, whereby a filled cup is automatically removed from the cup chamber, which thereby quickly is ready for a new purchase. The dispenser may therefore prepare several cups of beverages without necessitating that the customer removes the filled cup at once.

According to the invention it is particularly advantageous when the bottom plate is a fixedly mounted, horizontal disc comprising guides capable of co-operating with the lower part of a cup in such a manner that said cup is guided both in radial direction relative to the cup chamber during the rotation of the rotor and automatically carried out of the cup chamber during the passage of said cup chamber past the discharge opening. In this manner the cup is automatically transferred to the cup chamber in a simple manner.

The dispenser may according to the invention comprise a cover magazine with a dispensing mechanism adapted to remove a cover from the cover magazine and to discharge it to a cup during the movement of said cup to the discharge opening, thus permitting a particularly quick fixing of the covers.

According to the invention it is preferred that the dispenser is characterized in that the cover magazine comprises a tubular, displaceably mounted container with an open bottom, said container receiving a stack of covers supported by a supporting plate, on top of which the cover stack slides during the displacement of the tubular container, and that the cover dispensing mechanism comprises a separator separating the lowermost cover from the stack of covers during the passage of the container past the separator, and that the rotor comprises a dog pushing the cover removed from the stack away from the cover dispensing mechanism and downwards onto a cup, whereafter the cup with cover passes a pressing means pressing the cover firmly onto the cover, and optionally a stamping means providing the cup with a mark or the like characteristic of the beverage in question.

According to the invention the separator may particularly simply be a thin bar, which in the nonactivated position is horizontally situated across the path of the magazine container and on a level below the lowermost rim of the lowermost but one cover in the stack of covers, said bar being loosely mounted at both ends in an oblong hole extending obliquely upwards, whereby these oblong holes are shaped in permanent parts of the dispenser, and the cover dispensing mechanism may comprise a slot shaped under the separator bar in the supporting plate of the stack of covers, said slot being dimensioned in such a manner that the lowermost cover during the separating procedure is carried downwards through the slot, and supporting brackets may be provided below the slot in the supporting plate, whereby the supporting brackets are adapted temporarily to carry the separated cover in the path of the dog present on the rotor, said supporting brackets projecting towards each other in such a manner that a passage or slot for the dog is formed therebetween.

In order to guide the cover during the fixing thereof onto a cup, the supporting brackets may according to the invention be shaped in connection with cover-guiding side walls guiding the cover during the displacement downwards onto a cup.

According to the invention it is preferred that the pressing means comprises two rollers freely pivotably mounted on a shaft at such a mutual distance that the dog may pass freely.

Finally according to the invention, the shaft of the rollers may be adjustable in height and resiliently mounted, whereby a particularly careful handling of the cups with covers is obtained.

Figure 2:
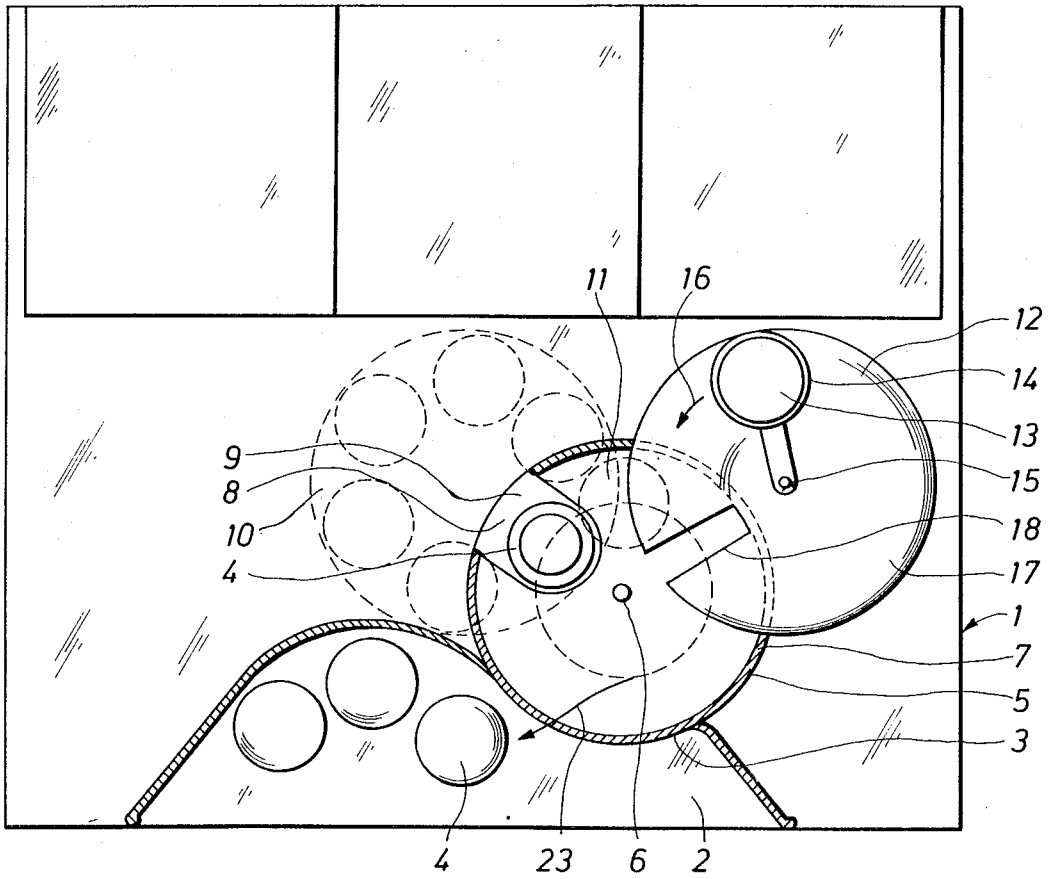
Figure 3:
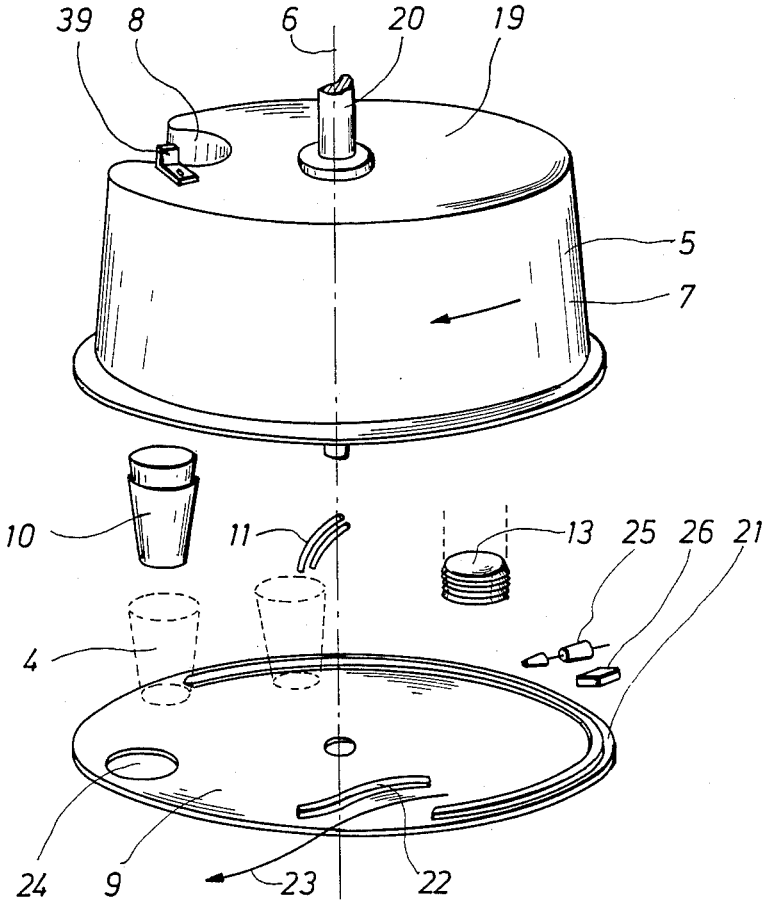
Figure 4:
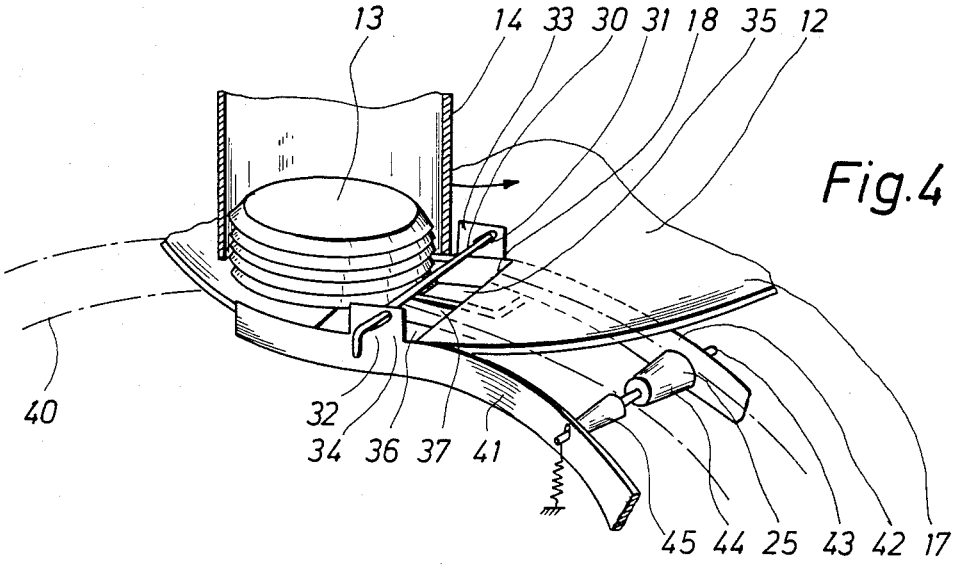
Figure 5:
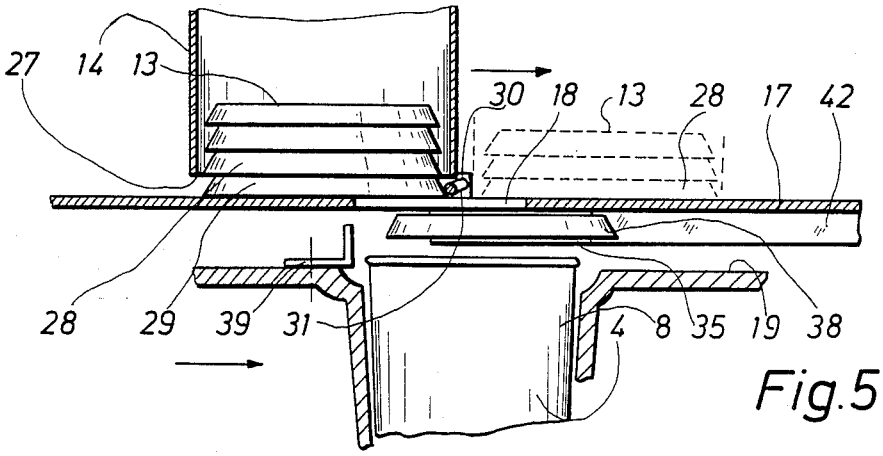
Figure 6:
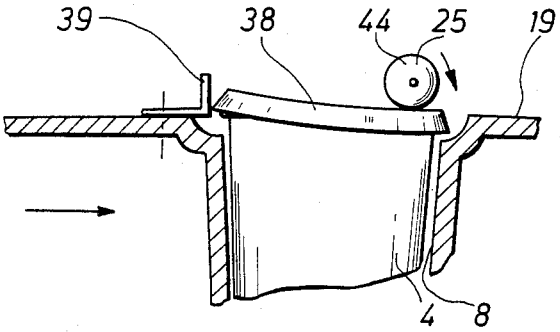
Figure 7:
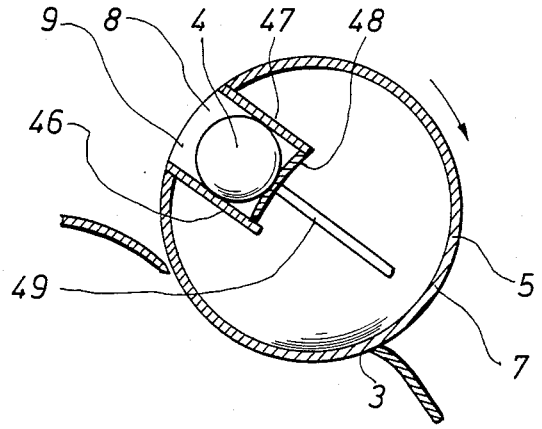
Figure 8:
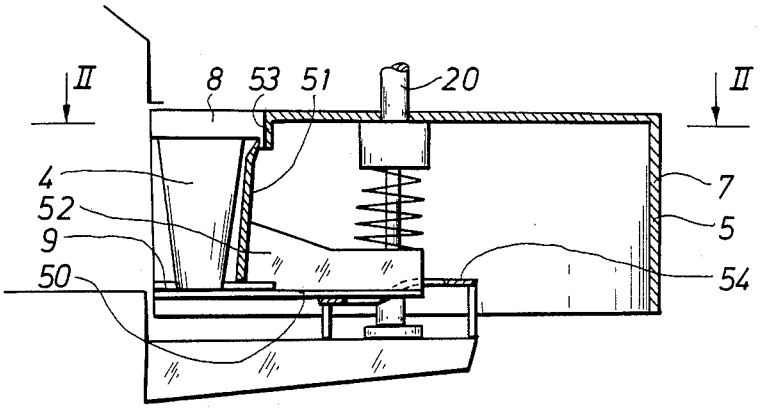
Figure 9:
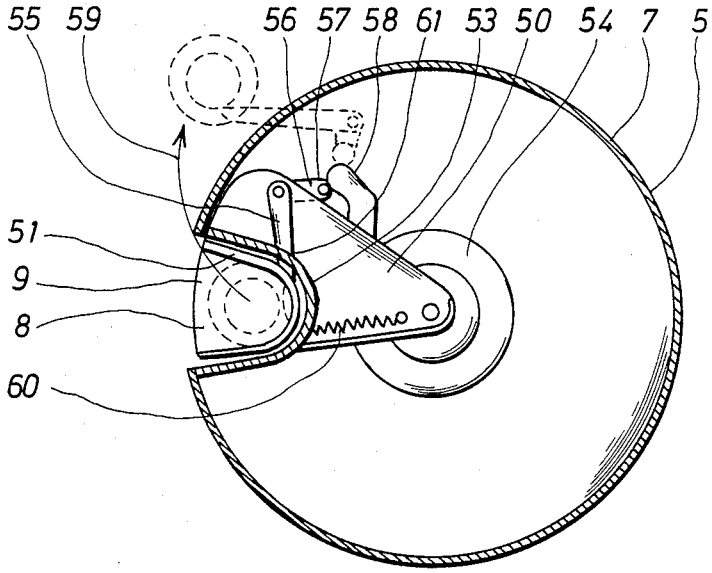

The invention will be described below with reference to the accompanying drawing, in which FIG. 1 illustrates part of a dispenser according to the invention, seen from the outside in a direction towards a dispensing chamber, FIG. 2 is a diagrammatic, sectional view taken along the line I—I of FIG. 1, FIG. 3 is a perspective view of a preferred embodiment of a rotor and an associated bottom plate, whereby the rotor and the bottom plate are separated and various parts of the dispenser are diagrammatically indicated, FIG. 4 is a perspective view of part of a preferred embodiment of a cover dispensing mechanism, parts being removed for the sake of clarity, FIG. 5 is a diagrammatic, vertical, sectional view of the embodiment of FIG. 4 of a cover dispensing mechanism together with an adjacent part of the rotor of the dispenser having a cup situated in the cup chamber, FIG. 6 is a vertical, sectional view through a cup chamber with a cup provided with a cover, illustrated during the passage of the cup below a pressing means, FIG. 7 is a horizontal, sectional view through a second embodiment of a rotor, FIG. 8 is a vertical sectional view through a third embodiment of a rotor with a cup chamber adaptable to various cup sizes, and FIG. 9 is a sectional view taken along the line II—II of FIG. 8.

The dispenser illustrated in FIG. 1 is provided with the general reference numeral 1 and comprises on the front side a dispensing chamber 2 communicating posteriorly with the interior of the dispenser through a discharge opening 3. Through this discharge opening 3, the dispenser discharges at appropriate activation cups 4 containing an appropriate, completely prepared beverage from the interior of the dispenser.

As illustrated especially in FIG. 2, a rotor 5 is situated immediately inside the opening 3 and is pivotably mounted about a vertical shaft 6. This rotor comprises a peripheral wall 7 extending in axial direction and situated close to the discharge opening 3 in such a manner that said opening is completely closed by part of the peripheral wall during the greater part of rotation of the rotor 5. In connection with this peripheral wall 7, the rotor 5 comprises an axially extending recess 8 shaped in such a manner that it can receive a cup 4. In this manner this recess 8 serves as a cup chamber on the rotor, the cup 4 being supported downwardly by a bottom plate 9.

As diagrammatically illustrated in FIG. 2, the rotor 5 is associated with a cup dispensing means 10 indicated by dotted lines. This cup dispensing means contains stacks of cups and transfers in a manner known per se a cup to the cup chamber 8 of the rotor at activation of the dispenser and when the cup chamber 8 is situated in a correct starting position below the cup dispensing means. The rotor 5 is furthermore associated with a beverage preparing station indicated by the reference numeral 11. This station may, if desired, be situated at the starting position of the cup chamber 8, and at said station the cup 4 is filled with the desired beverage in a manner known per se. As illustrated in FIG. 2, the dispenser is also provided with a cover dispensing device 12, which, if desired, provides the filled cup 4 with a cover from a stack 13 of covers in a container 14. As described more detailed below, this container 14 is adapted to rotate about a vertical shaft 15 in the direction indicated by means of an arrow 16 in accordance with the rotation of the rotor 5, which in the drawing is clockwise. The container 14 with the stack of covers rotates on top of a supporting plate 17 provided with a slot 18. The covers are carried to the cups through this slot 18 in the manner described in greater detail below.

When a customer has activated the dispenser, the rotor 5 rotates the cup chamber 8 stepwise into the filling position 11, said cup chamber being provided with an empty cup 4. Subsequently, the filled cup 4 is carried in a continuous rotating movement to the discharge opening 3 of the dispenser through the cover dispensing device 12. At the discharge opening 3, the filled cup 4 is pushed into the cup dispensing chamber 2 where it awaits to be removed by a customer. As indicated in FIGS. 1 and 2, the dispensing chamber is appropriately shaped in such a manner that several filled cups may be simultaneously situated therein. Upon the transfer of the filled cup to the dispensing chamber, the rotor 5 continues its movement until the cup chamber again is situated in the starting position and ready to receive a fresh cup.

The embodiment illustrated in FIG. 3 of a rotor 5 is shaped as a bell with a horizontal top side 19 and a peripheral wall 7 of a slighter inclination (conicity). This bell comprises a recess forming the cup chamber 8, said recess being shaped integral with the peripheral wall 7 and the horizontal top side 19. The bell-shaped rotor is pivotably mounted about a shaft 20 and is connected with a horizontal permanent bottom plate 9 in the form of a disc of almost the same radius as the lowermost part of the bell 5. This disc is provided with oblong ridges 21 and 22 of such a shape and situated in such a manner that they form guides for a cup 4 situated in the cup chamber 8, the lowermost edge of the cup engaging said guides during the movement of the rotor 5. The cup 4 situated in the cup chamber is guided radially inwards into the cup chamber 8 by means of one guide 21 extending in a curve along the periphery of the disc-shaped bottom plate 9 until a point adjacent the discharge opening 3 of the dispenser. At this point, the lowermost edge of the cup 4 engages the second guide 22 guiding the filled cup outwards through the discharge opening 3 in the direction indicated by means of an arrow 23. The first guide 21 and the walls of the cup chamber ensure the accurate positioning of the cup 4 within the cup chamber 8 during the transfer of the cup 4 from the starting position at the cup dispensing means 10 to the discharge opening 3. The bottom plate 9 may be provided with an orifice 24, cf. FIG. 3, and when returning to the starting position, the cup chamber 8 passes this orifice whereby possible impurities fall through said orifice and are thereby prevented from interrupting the correct function of the dispenser.

FIG. 3 illustrates the various stations in connection with the bottom plate 9 in order simultaneously to illustrate the position of the guides 21 and 22 relative thereto. Upon discharge of a cover from the stack 13 of covers, the cup with cover passes a pressing means 25 pressing the cover firmly onto the cup. Having passed this pressing means, the cup passes a stamping means 26 providing the cup with a mark or the like characteristic of the beverage in question.

The cover dispensing device 12 is illustrated in greater detail in FIGS. 4 and 5, whereby only the essential parts are shown for the sake of clarity. The container 14 receiving a stack 13 of covers is tubular and comprises an open bottom. The lowermost rim 27 of the container 14 is situated on a level above the supporting plate but slightly below the lowermost rim of the lowermost but one cover 28 in the stack 13. The lowermost cover, which is provided with the reference numeral 29, is supported by the supporting plate 17. During the rotation of the container 14 about the shaft 15, the lowermost cover slides on top of this supporting plate 17.

Immediately above the slot 18 in the supporting plate 17, the cover dispensing device comprises a separating bar 30. In the nonactivated position this separating bar is horizontally situated on a level below the lowermost rim of the lowermost but one cover 28 and also on a level below the lowermost rim 27 of the container. At both ends this separating bar is mounted in an oblong hole 31 and 32, respectively, obliquely extending and situated in permanent portions of the dispenser, the oblong hole 31 being shaped on a part 33 integral with the supporting plate 17, whereas the oblong hole 32 is shaped in a part 34 situated outside the supporting plate 17. Immediately below this separating bar, two supporting brackets 35 and 36 are provided which comprise horizontal portions extending from their respective end of the slot 18 towards each other, a slot 37 being formed therebetween.

During the passage of the container 14 across the slot 18, the lowermost cover 29 hits the separating bar 30. Owing to the loose mounting of this bar in the oblong holes 31, 32, the separating bar slides upwards along the side of the cover and inwards under the lowermost rim of the lowermost but one cover 28. As a result, this lowermost but one cover 28 is pressed away from the lowermost cover 29 in such a manner that said lowermost cover is released from the stack 13 of covers and guided downwards under the separating bar 30 and downwards through the slot 18 where it is catched by the supporting brackets 35 and 36. The condition of the stack after the passage of the separating bar 30 and the separation of the lowermost cover 29 is indicated by dotted lines in FIG. 5. FIG. 5 furthermore illustrates a cover 38 being previously separated from the stack 13 and resting on top of the supporting brackets 35 and 36, only the supporting bracket 35 appearing from FIG. 5. As illustrated in FIGS. 5 and 6 and FIG. 3 too, the rotor comprises a dog 39 situated on the top side 19 of the rotor. This dog is correctly situated relative to the cup chamber 8 in such a manner that it has the same distance to the axis of rotation 6 of the rotor as the centre of a correctly situated cup in the cup chamber 8. This dog is secured in a manner not described in details, but optionally in such a manner that it is adjustable. The path of the dog 39 appears from FIG. 4 by means of the dotted curve 40. The cover dispensing device with the separator is situated in such a manner relative to the path 40 of the dog 39, cf. FIG. 4, that the dog 39 passes through the slot 37 between the supporting brackets 35 and 36 during the rotation of the rotor. As a result, the dog 39 pushes the cover 38 situated on the supporting brackets 35 and 36 downwards off the supporting brackets 35 and 36. A correct adjustment of the dog 39 implies that the cover 38 falls on top of the cup 4.

As illustrated in FIG. 4, the supporting brackets 35 and 36 are shaped in connection with vertical walls 41, 42. These vertical walls are situated and curved in such a manner that they form guiding surfaces for the cover 38 during its movement from the supporting brackets 35 and 36 downwards onto the cup 4. The part 34 comprises the oblong hole 32 outside the periphery of the supporting plate 17 and is appropriately shaped integral with one of these cover-guiding side surfaces 41.

An appropriate distance from the supporting brackets 35 and 36, these cover-guiding side surfaces comprise an almost horizontal shaft 43. Between the cover-guiding walls 41 and 42, this shaft 43 carries two loosely mounted rollers 44, 45 situated at such a mutual distance that the dog 39 may pass freely therebetween. Furthermore these rollers 44, 45 are situated in such a manner relative to the rotor 5 and the path of the cup 4 that they engage the cover 38 and press said cover firmly onto the cup 4. As indicated in FIG. 4, the shaft 43 may be spring-loaded in a direction towards the cup 4 in such a manner that it is adjustable in height relative to the cup 4 and the cover 38.

The rollers 44, 45 are conically shaped in accordance with the path of the cover 38, cf. FIG. 4, whereby parts of the rollers do not slip relative to the cover.

The embodiment illustrated in FIG. 7 of a rotor 5 comprises a peripheral wall 7 and a cup chamber 8 as the embodiment described above. The cup chamber 8 in this embodiment is formed by parallel side walls 46, 47 and a curved end wall 48 of the same radius of curvature as the peripheral wall 7. This curved end wall 48 is connected to a linkage indicated by the reference numeral 49. This linkage is controlled so that the cup by displacement of the wall 48 is automatically pushed out of the cup chamber 8 when said chamber opposes the discharge opening 3. At the same time this wall 48 closes temporarily the opening of the cup chamber facing outwards after discharge of the cup.

The embodiment of the rotor 5 illustrated in FIGS. 8 and 9 comprises as the previous embodiments, a peripheral wall 7 and a cup chamber 8. In this embodiment, the bottom plate 9 of the cup chamber is formed by a pivotably mounted plate 50 mounted about the same shaft as the rotor 5 and furthermore carrying a part 51 of the vertical wall of the cup chamber, this part 51 being carried by a part 52 projecting vertically upwards on the bottom plate-forming plate 50. The remaining part of the wall of the cup chamber is formed by a part 53 projecting downwards and integral with the rotor. These two parts 51, 53 of the wall of the cup chamber are shaped in such a manner that they are displaceable relative to each other in a telescopic manner. The plate 50 slides on top of a guide 54 shaped so that the plate 50 and consequently also the part 51 of the wall of the cup chamber are vertically displaceable during the rotation of the rotor. As a result, the cup may be transferred from one level to another, e.g. from the cup dispensing means 10 to the cover dispensing device 12 so that the cup is correctly positioned relative to the cover dispensing device. By replacing the guide 54, the dispenser is easily adjustable from one cup size to another.

As illustrated in FIG. 9, a pawl 55 is pivotably mounted on the plate 50. This pawl is permanently connected to an arm 56 carrying a roller 57 at the opposite end. During the rotation of the rotor 5, this roller follows a cam track 58 shaped in such a manner that the pawl 55 automatically pushes the cup 4 outwards into the dispensing chamber when the cup chamber 8 opposes the discharge opening 3, cf. the arrow 59 and the position of the pawl indicated by dotted lines. As indicated, the pawl is appropriately connected to a spring 60 automatically retracting said pawl towards a stop 61 in such a manner that the roller 57 is kept engaging the cam track 58 during the rotation of the rotor 5.

The invention has been described with reference to preferred embodiments. Many amendments may be performed without thereby deviating from the scope of the invention. The actuator of the rotor may for instance be connected to a coupling preventing a continued rotation of the rotor when for instance a finger is caught between the rotor and one rim at the discharge opening. The rotor may possibly be provided with photocells too, which registrate whether the cup is out of the cup chamber and whether said cup chamber is empty.

The rotation of the rotor is actuated in a manner known per se, and it is also adjusted to the movement of the remaining parts of the means of the dispenser in a manner known per se, e.g. the container dispensing means 10, the filling station 11, and the cover dispensing device 12.

I claim:

1. A cup dispenser for cups containing freshly made beverages, said dispenser comprising a discharge opening forming a connection between an interior of the dispenser and a dispensing chamber, from which a filled cup being removed, the dispenser having a rotor pivotably mounted about a vertical shaft and having a peripheral wall extending in axial direction and co-operating with the discharge opening from the interior in such a manner that said discharge opening is completely closed by part of the peripheral wall in any position of the rotor apart from the position in which a cup chamber shaped on said rotor opposes the discharge opening, said cup chamber forming a recess in the peripheral wall.

2. A dispenser as claimed in claim 1, wherein the rotor is formed as a bell, whereby the cup chamber extends substantially axially through said bell adjacent the peripheral wall thereof and comprises a separate bottom plate supporting the cups.

3. A dispenser as claimed in claim 1, wherein the wall of the cup chamber is formed by telescopic members permitting adjustment of the axial extension of the cup chamber by displacing the bottom plate of the cup chamber.

4. A cup dispenser for cups containing freshly made beverages, said dispenser comprising a discharge opening forming a connection between an interior of the dispenser and a dispensing chamber, from which the filled cup being removed, the dispenser having a rotor pivotably mounted about a vertical shaft and having a peripheral wall extending in axial direction and cooperating with the discharge opening from the interior in such a manner that said discharge opening being completely closed by part of the peripheral wall in any position of the rotor apart from the position in which a cup chamber shaped on said rotor opposes the discharge opening. said cup chamber forming a recess in the peripheral wall, the rotor being associated with means for automatic transferring of a filled cup to the dispensing chamber when the cup chamber being opposed the dispensing chamber, said dispenser having a bottom plate with guide means, said guide means cooperating with a lower part of a cup in a such manner that said cup being simultaneously guided in radial direction relative to the cup chamber during the rotation of the rotor and being carried out of the cup chamber when said cup chamber passes the discharge opening.

5. A dispenser as claimed in claim 4 comprising a cover magazine with a dispensing mechanism adapted to remove a cover from the cover magazine and to discharge it to a cup during the movement of said cup to the discharge opening.

6. A dispenser as claimed in claim 5, wherein the cover magazine having a tubular, displaceably mounted container with an open bottom, said container receiving a stack of covers supported by a supporting plate, on top of which the cover stack slides during the displacement of the tubular container, and that the cover dispensing mechanism comprises a separator separating the lowermost cover from the stack of covers during the passage of the container past the separator, and that the rotor comprises a dog pushing the cover removed from the stack away from the cover dispensing mechanism and downwars onto a cup, whereafter the cup with the cover passes a pressing means pressing the cover firmly onto the cover, and optionally a stamping means providing the cup with a mark or the like characteristic of the beverage in question.

7. A dispenser as claimed in claim 6, wherein the separator being a thin bar, which in the nonactivated position is horizontally situated across the path of the magazine container and on a level below the lowermost rim of the lowermost but one cover in the stack of covers, said bar being loosely mounted at both ends in an oblong hole extending obliquely upwards whereby these oblong holes are shaped in permanent parts of the dispenser, and that the cover dispensing mechanism comprises a slot shaped under the separator bar in the supporting plate of the stack of covers, said slot being dimensioned in such a manner that the lowermost cover during the separating procedure is carried downwards through the slot, and that supporting brackets are provided below the slot in the supporting plate, whereby the supporting brackets are adapted temporarily to carry the separated cover in the path of the dog present on the rotor, said supporting brackets projecting towards each other in such a manner that a passage or slot for the dog is formed therebetween.

8. A dispenser as claimed in claim 7, wherein the supporting brackets are shaped in connection with cover-guiding side walls guiding the cover during the displacement downwards onto a cup.

9. A dispenser as claimed in claim 6, wherein the pressing means comprises two rollers freely pivotably mounted on a shaft at such a mutual distance that the dog may pass freely.

10. A dispenser as claimed in claim 9, wherein the shaft of the rollers is adjustable in height and resiliently mounted.

11. The dispenser as claimed in claim 4 wherein said bottom plate being positioned substantially horizontally.

* * * * *